US005669603A

United States Patent [19]

Detmers et al.

[11] Patent Number: 5,669,603

[45] Date of Patent: Sep. 23, 1997

[54] METHOD AND DEVICE FOR GUIDING A SHEET WITH A PNEUMATIC SHEET FLOATATION GUIDE

[75] Inventors: Andreas Detmers, Mauer; Günter Stephan, Wiesloch-Baiertal, both of Germany

[73] Assignee: Heidelberger Druckmaschinen AG, Heidelberg, Germany

[21] Appl. No.: 531,417

[22] Filed: Sep. 21, 1995

[30] Foreign Application Priority Data

Sep. 21, 1994 [DE] Germany ..... 44 33 644.6

[51] Int. Cl.[6] ..... B65H 29/68

[52] U.S. Cl. ..... 271/183; 271/195

[58] Field of Search ..... 271/182, 183, 271/195, 202, 203, 204, 211

[56] References Cited

U.S. PATENT DOCUMENTS

| | | | |
|---|---|---|---|
| 2,261,972 | 11/1941 | Matthews | 271/195 |
| 3,779,545 | 12/1973 | Schuhmann et al. | 271/183 |
| 3,933,351 | 1/1976 | Mayer et al. | 271/183 |
| 4,317,563 | 3/1982 | Zimmerman et al. | 271/211 |
| 4,479,645 | 10/1984 | Pollich | 271/183 |

FOREIGN PATENT DOCUMENTS

| | | | |
|---|---|---|---|
| 789419 | 7/1968 | Canada | 271/195 |
| 87 586 | 2/1972 | German Dem. Rep. . | |
| 2 048 278 | 5/1971 | Germany . | |
| 23 58 206 | 2/1979 | Germany . | |
| 32 21 598 | 1/1983 | Germany . | |
| 34 00 336 | 11/1984 | Germany . | |
| 38 41 909 | 10/1989 | Germany . | |
| 40 12 940 | 10/1991 | Germany . | |
| 32 30 436 | 3/1992 | Germany . | |
| 39 38 863 | 6/1992 | Germany . | |
| 41 06 904 | 9/1992 | Germany . | |
| 1 538 108 | 1/1979 | United Kingdom . | |
| 2276150 | 9/1994 | United Kingdom | 271/195 |

OTHER PUBLICATIONS

VEB Printing Machine Publ., May 13, 1965, pp. 2–5, for a delivery device for sheet printing machines.

*Primary Examiner*—Boris Milef

*Attorney, Agent, or Firm*—Herbert L. Lerner; Laurence A. Greenberg

[57] ABSTRACT

Method for guiding a sheet in vicinity of a sheet slow-down device of a sheet-processing machine. The sheet is gripped at a leading edge thereof with of a gripper system and the sheet is transported in a sheet-transport direction along a sheet travel path. The sheet has a defined region with which the sheet comes into contact with a sheet slow-down device for subsequently forming a sheet pile, and directing the sheet, in the vicinity of the sheet slow-down device, into a range of influence of a flotation guide produced along a guiding surface member by an air flow. The flotation guide, without taking into account the influence of the sheet slow-down device, is effective for bringing the sheet to a normal flotation level located above the guiding surface member. The sheet is supplied to the sheet slow-down device at a height level above the normal flotation level in order to form sheet-stabilizing vacuum forces resulting from the air flow. There is also disclosed a device for performing the method.

8 Claims, 4 Drawing Sheets

METHOD AND DEVICE FOR GUIDING A SHEET WITH A PNEUMATIC SHEET FLOATATION GUIDE

BACKGROUND OF THE INVENTION

1. Field of the Invention:

The invention relates to a method for guiding a sheet in a vicinity of a sheet slow-down device of a sheet-processing machine, more particularly, a sheet-fed printing press, the sheet being gripped at a leading edge thereof by a gripper system and being transported along a sheet travel path, the sheet having a defined region, preferably a trailing edge thereof, with which it comes into contact with a sheet slow-down device for subsequently forming a sheet pile.

2. Description of Related Art including Information Disclosed Under 37 CFR 1.97 to 1.99:

Methods of the aforementioned general type have become known heretofore. In the case of a printing press, sheets passing through the printing units are supplied to a delivery, which is equipped with a preferably revolving gripper system. The grippers of the gripper system grip the respective sheet at the leading edge thereof and transport it, if necessary or desirable, while it is passing through drying apparatuses, to a sheet slow-down device, the purpose of which is to slow down the sheets released by the grippers, so that they are able to impact or come into contact, without damage, with stops for the purpose of forming a sheet pile. The sheet slow-down device, which may preferably be in the form of a suction tape or suction drum, grips the sheet in a preferably defined region, particularly at the trailing edge of the sheet, and brakes or slows it down to a defined speed. Preferably, the suction tape of the sheet slow-down device and the suction drum thereof, respectively, moves in the direction of sheet movement or travel, but at a reduced speed compared with the travel speed of the sheet, so that there is a relative movement on the sheet slow-down device. A flow of air around a gripper bar, which carries the grippers of the gripper system, results in a formation of vortices, which cause the sheet to flutter in given zones, particularly in dead zones, and accordingly opposes a stable slow-down or braking by the sheet slow-down device. Moreover, the fluttering movement of the sheet may cause the sheet to adhere to a delivery drum which transfers the sheet from the printing unit to the gripper system. In any case, the sheet which has been caused to flutter due to the movements thereof is not gripped in a defined manner by the sheet slowdown device, so that no regular slowing-down or braking thereof occurs. This may result in the production of misaligned or out-of-square sheets, early or overshooting sheets or late or excessively braked sheets at the sheet delivery. In order to solve the aforementioned problems, it has been proposed heretofore to permit blast air to act upon the sheets from above by means of blast-air tubes or fans, so that, due to the blast air, the sheets are pressed in a defined manner onto the sheet slow-down device. To produce effective air blasting or blowing requires high volumetric flow rates, however, and the off-flowing blast air, in addition, leads to disruptions in the sheet travel, due to which, it is likewise impossible to ensure that the respective sheet will be gripped reliably by the sheet slow-down device. Furthermore, conventional attempts at a solution have led to problems whenever the size or format of the sheets is varied, because, in such cases, it is necessary to adapt or adjust to the size of sheet, such adaptation or adjustment being quite complicated and technically expensive.

SUMMARY OF THE INVENTION

It is consequently an object of the invention to provide a method and device of the initially mentioned type for guiding a sheet by which it is possible to achieve a stable slow-down or braking of the sheet and an optimum sheet delivery.

With the foregoing and other objects in view, there is provided, in accordance with the invention, a method for guiding a sheet in vicinity of a sheet slow-down device of a sheet-processing machine, which includes gripping the sheet at a leading edge thereof by means of a gripper system and transporting the sheet in a sheet-transport direction along a sheet travel path, the sheet having a defined region with which the sheet comes into contact with a sheet slow-down device for subsequently forming a sheet pile, which comprises directing the sheet, in the vicinity of the sheet slow-down device, into a range of influence of a flotation guide produced along a guiding surface member by an air flow, the flotation guide, without taking into account the influence of the sheet slow-down device, being effective for bringing the sheet to a normal flotation level located above the guiding surface member, the sheet being supplied to the sheet slow-down device at a height level above the normal flotation level in order to form sheet-stabilizing vacuum forces resulting from the air flow.

In accordance with another mode of the method, the height level is at a given spaced distance above the normal flotation level, the given distance being greater than sheet-movement amplitudes potentially occurring in a sheet located at the normal flotation level.

In accordance with a further mode of the method, the flow direction of the air flow of the flotation guide is in the sheet-transport direction.

In accordance with an added mode of the method, the flow direction of the air flow of the flotation guide is opposite to the sheet-transport direction.

In accordance with an additional mode of the method, the air flow of the flotation guide has at least one cross-flow component extending transversely to the sheet-transport direction.

In accordance with yet another mode of the method, the air flow of the flotation guide has a plurality of cross-flow components disposed symmetrically with respect to the sheet-transport direction.

In accordance with yet a further mode of the method, the flotation guide is disposed upstream of the sheet slow-down device, as viewed in the sheet-transport direction.

In accordance with yet an added mode of the method, the flotation guide is disposed downstream of the sheet slow-down device, as viewed in the sheet-transport direction.

In accordance with yet an additional mode of the method, the flotation guide is disposed laterally adjacent the sheet slow-down device, as viewed in the sheet-transport direction.

In accordance with a concomitant aspect of the invention, there is provided a device for guiding a sheet in vicinity of a sheet slow-down device of a sheet-processing machine having a gripper system for gripping the sheet at a leading edge thereof and transporting the sheet along a sheet travel path, the sheet having a defined region at which the sheet comes into contact with the sheet slow-down device for subsequently forming a sheet pile, comprising a flotation guide formed in the vicinity of the sheet slow-down device, the flotation guide comprising an air flow device for directing air flow along a guiding surface member, the air flow, without taking into account the influence of the sheet slow-down device, being effective for bringing the sheet to a normal flotation level located above the guiding surface member, the sheet being supplied to the sheet slow-down device at a height level above the normal flotation level in order to form sheet-stabilizing vacuum forces resulting from the air flow.

Preferably, the sheet-processing machine is a sheet-fed printing press, and the defined region of the sheet is the trailing edge thereof.

According to the invention, therefore, a flotation guide is formed in the region of the sheet slow-down device. This means that an air flow moving along a guiding surface gives rise to a state of flotation of the sheet; that is, the sheet is disposed at a level above the guiding surface without touching the guiding surface. This level may be at 1 mm to 3 mm, for example, above the guiding surface. This state of flotation is dependent upon several parameters:

1. Force of gravity acting upon the sheet;

2. Atmospheric pressure acting upon the sheet;

3. Forces acting upon the sheet due to the flotation guidance; and

4. Dynamic forces capable of producing fluttering or the like in the sheet.

These dynamic forces may be produced, for example, by the air flow of a dryer situated in the vicinity of the delivery of the sheet-processing machine. If the effect of the sheet slow-down device, which exerts a suction force on the sheet, is not taken into consideration with regard to the following, then the equalization of forces from the aforementioned circumstances means that the sheet floats to the normal level. Possible fluttering, for example, due to dynamic forces, causes the sheet to be deflected (amplitudes), particularly zonally, about this normal flotation level, an upward deflection, i.e., away from the guiding surface, resulting in a widening of the gap between the guiding surface and the sheet, thereby giving rise to a downward vertical force acting upon the sheet, such downward vertical force returning the sheet or a partial region thereof to the normal flotation level. Deflections in the direction of the guiding surface, i.e., those that result in a narrowing of the gap between the guiding surface and the sheet or section of the sheet, cause an upwardly-directed vertical force and, consequently, likewise entail a return to the normal flotation level. These either upwardly or downwardly-acting vertical forces result from the flotation guide. If the sheet is supplied to the sheet slow-down device at a height level that is above the normal flotation level, the sheet is permanently subjected to a downwardly-directed vertical force which very greatly damps or even prevents any fluttering. Because the sheet slow-down device is disposed at the height level located above the normal flotation level, the sheet is supplied, under the action of the vertical forces, to the sheet slow-down device in a defined and steady, i.e., flutter-free, manner, thereby giving rise to an optimum and reproducible slow-down or braking process. Consequently, there are stable conditions which prevent misaligned sheets, early sheets or late sheets and which, overall, permit error-free and optimum operational management. The forces acting due to the guidance of the sheet above the normal flotation level in the vicinity of the sheet slow-down device result from the fact that the sheet has a tendency to adjust to or seek the normal floatation level. If the sheet is forced to a higher level, due to the sheet slow-down device, the air flow which causes the flotation guidance has a larger gap available between the guiding surface and the underside of the sheet, thereby leading to the formation of a vacuum, due to which the aforementioned downwardly-directed vertical forces are produced.

According to a further development of the invention, the height level is located at a distance above the normal flotation level, that distance being greater than sheet-movement amplitudes which would occur in the case of a sheet located at the normal flotation level. This also being based upon the premise of a state of the sheet on the normal flotation level, in order to illustrate the invention, that state merely being intended to conceptually explain the situation, but not being assumed during operation. If, therefore, a sheet is at the normal flotation level, then, as explained hereinbefore, deflections (amplitudes) are diminished by stabilizing forces, due to which the amplitudes of oscillation decrease. If the amplitudes are considered theoretically, they lead to a defined degree of deflection with respect to the normal flotation level. If the height level at which the sheet is supplied to the sheet slow-down device is disposed at a distance above the normal flotation level which is greater than the sheet-movement amplitudes which would result based upon a theoretically considered sheet that is at the normal flotation level, then there is always the assurance that the sheet-stabilizing vertical forces caused by vacuum forces will act upon the sheet and, with absolute certainty, will guide it in a stable and optimum manner in the vicinity of the sheet slow-down device.

Further of advantage is a flow direction of the air flow of the flotation guide in the sheet-transport direction. Alternatively, however, the flow direction of the air flow of the flotation-guiding arrangement is opposite to the sheet-transport direction.

Moreover, there is the possibility that the air flow of the flotation guide may have at least one cross-flow component extending transversely to the sheet-transport direction. The cross-flow component leads, together with the main air-flow component directed in the sheet-transport direction or opposite to the sheet-transport direction, to an air flow which is directed obliquely outwards or, as the case may be, obliquely inwards with respect to the sheet-transport direction. An obliquely outwardly-directed air flow, which tautens the sheet, is preferred. In particular, a plurality of cross-flow components disposed symmetrically with respect to the sheet-transport direction is preferred. The symmetry ensures that the obliquely directed flows act evenly at the side regions, as a result of which there is an even application of forces and tautening of the sheet.

In addition, it is advantageous for the flotation guide to be positioned before the sheet slow-down device, as viewed in the sheet-transport direction. Additionally or alternatively, however, the flotation guide may also be disposed after the sheet slow-down device, once again as viewed in the sheet-transport direction. Finally, in combination with the aforementioned possibilities or alternatively thereto, an embodiment is offered wherein the flotation guide is disposed laterally next to the sheet slow-down device. It is also possible to provide an integrated embodiment or solution; that is, the sheet slow-down device is situated in a region of the guiding surface which also accommodates the flotation guide. The flotation guidance is realized by means of one or more nozzles which are machined or formed particularly in alignment in the guiding surface and generate the air flow, which extends, in particular, parallel to the surface of the guiding surface and, therefore, also substantially parallel to the sheet-movement direction.

The invention relates further to a device for guiding a sheet in the vicinity of a sheet slow-down device of a sheet-processing machine, particularly a sheet-fed printing press, the sheet, gripped at its leading edge by means of a gripper system, being transported along a sheet-travel path and, by a defined region, preferably a trailing edge thereof, coming into contact with a sheet slow-down device for the purpose of subsequent pile formation, a flotation guide being formed in the vicinity of the sheet slow-down device, the flotation guide having an air flow flowing along a guiding surface, the air flow, without taking the influence of the sheet slow-down device into consideration, tending to bring the sheet to a normal flotation level situated above the guiding surface, the sheet being supplied to the sheet slow-down device at a height level which is above the normal flotation level, in order to form sheet-stabilizing vacuum forces caused by the air flow.

Other features which are considered as characteristic for the invention are set forth in the appended claims.

Although the invention is illustrated and described herein as a method and device for guiding a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
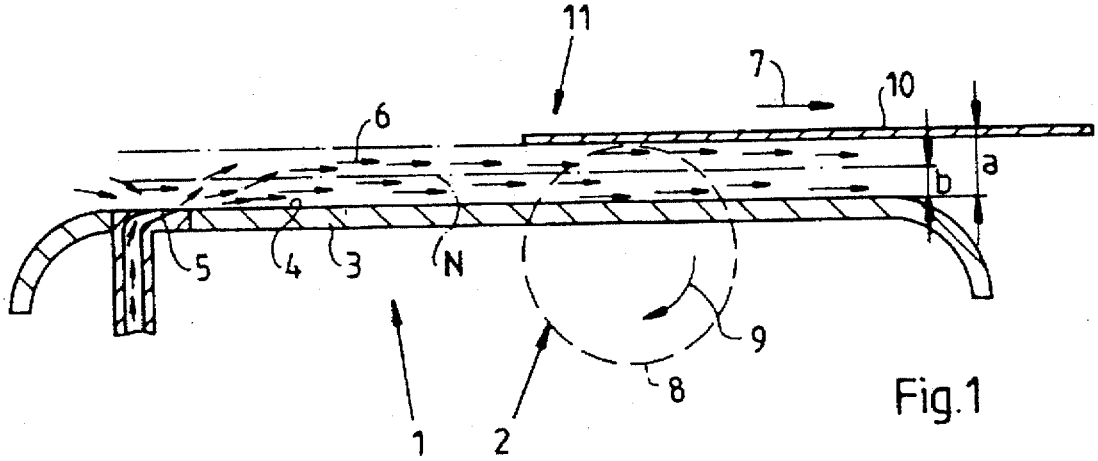
FIG. 1 is a schematic and diagrammatic longitudinal sectional view of a guiding surface section of a delivery of a sheet-fed printing press in the vicinity of a sheet slow-down device according to the invention.

Referring now to the drawings and, first, particularly to FIG. 1 thereof, there is shown therein, in a schematic and diagrammmatic view, a flotation guide 1 formed in the end region of an otherwise non-illustrated delivery of a sheet-fed printing press, the flotation guide 1 being associated with a sheet slow-down or braking device 2. The flotation guide 1 is formed with a guiding-surface member 3 having a surface 4 wherein mutually aligned air-blast nozzles 5 terminate, only one of the nozzles 5 being shown in FIG. 1, in the interest of simplicity. The air-blast nozzles 5 form an air flow 6, which extends substantially parallel to the surface 4 of the guiding-surface member 3 in the sheet-transport or travel direction represented by the arrow 7.

The flotation guide 1 is associated with or assigned to the sheet slow-down device 2 in such a manner that the latter is at a spaced distance a from the surface 4 of the guiding-surface member 3. The flotation guide 1 is made up of a plurality of suction rollers 8 disposed coaxially to one another and rotating, as indicated by the curved arrow 9, in the sheet travel direction represented by the arrow 7. Only one of the plurality of suction rollers 8 is illustrated in FIG. 1, likewise in the interest of simplicity. The suction rollers 8 rotate at a speed which is lower than the speed of the sheets in the sheet travel direction 7, due to which a respective suction-gripped sheet 10 executes a movement relative to the outer cylindrical surface of the suction rollers 8 and, consequently, is braked or slowed down to a lower speed, so that the sheet 10 is subsequently able, without damage, to be deposited on a sheet pile. Preferably, the slow-down or braking process is performed in such a manner that the sheet 10 is gripped by the suction rollers 8 in the vicinity of a trailing edge 11 of the sheet 10. It is believed to be readily apparent from FIG. 1 that the periphery of the suction rollers 8 is at a level above the surface 4 of the guiding-surface member 3, so that the aforementioned spaced distance a is formed.

Figure 2:
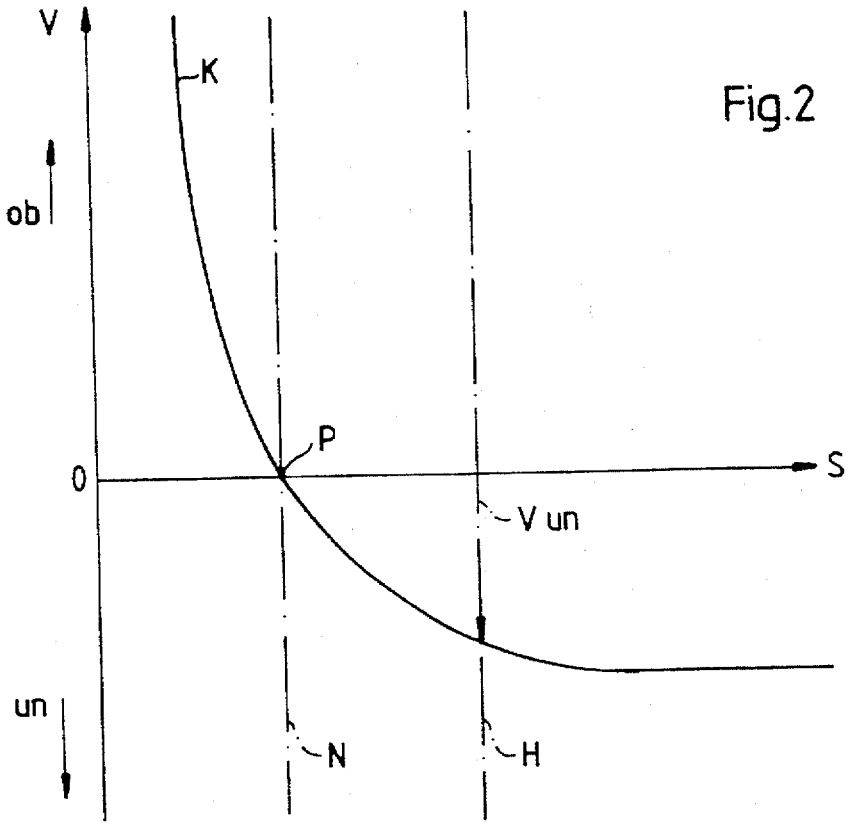
FIG. 2 is a plot diagram or graph of the vertical forces acting upon a sheet as a function of the height of a gap between the guiding surface and the sheet.

FIG. 2 is a plot diagram or graph having an ordinate along which vertical force V is plotted, and an abscissa along which gap height is plotted. In FIG. 1, the gap height corresponds to the spaced distance a, because it indicates the distance of the sheet 10 from the surface 4 of the guiding-surface member 3. The characteristic curve K in the plot diagram of FIG. 2 intersects the abscissa at a point P, at which the vertical force V is equal to zero. Above the abscissa, an upwardly-acting vertical force V, which is identified as "ob", is represented. Below the abscissa, on the ordinate, a downwardly-acting vertical force, which is identified as "un" is represented. At the point P, as mentioned hereinbefore, no vertical force V is exerted on the sheet, which, consequently, is disposed in a state of flotation at a normal flotation level N. The sheet is not subjected to any external influences. Looking at FIG. 1, in this regard, it becomes apparent that, if the sheet slow-down device 2 is not taken into consideration, the sheet 10 would move at the normal flotation level N, which is at a spaced distance b from the surface 4 of the guiding-surface member 3, the distance b being smaller than the distance a. The normal flotation level, however, is not a level at which the sheet 10 assumes any position, but is merely intended to explain the conditions which would prevail without the sheet slow-down device 2. If, for example through external influences, the sheet 10 is forced down to a level which is below the normal flotation level, then, referring to FIG. 2, an upwardly-acting vertical force V "ob" takes effect, due to which the sheet 10 (or, for example, oscillating portions thereof) has the tendency to re-assume the normal flotation level N. If, through external influences, the sheet 10 is brought to a higher level than the normal flotation level N, which is achieved according to FIG. 1 by a non-illustrated gripper system transporting the sheet 10, then a downwardly-acting vertical force V "un" takes effect. This is indicated in FIG. 2 by the level of height H. This height level H corresponds to the spaced distance a of the sheet 10 from the surface 4 of the guiding-surface member 3. When the gripper system thus moves the sheet 10, gripped at the leading edge thereof by means of grippers, along a sheet-guiding path at the distance a from the guiding-surface member 3 and when the active part of the sheet slow-down device 2 is likewise at the distance a above the guiding-surface member 3, assurance is provided that the vertical force V "un" will act on the sheet 10 in the vicinity of the sheet slow-down device 2 and will stabilize the sheet 10 with regard to fluttering and the like, so that the sheet 10 comes into contact, in a defined and reproducible manner, with the sheet slow-down device 2 and is optimally slowed down or braked. The vertical force V "un" results from the fact that there is a gap space extending over a distance a available for the air flow 6, the gap space being greater than for the case of an uninfluenced sheet guide, in which case the sheet 10 would hunt for or settle to the normal flotation level. Due to the "widened" or expanded air flow 6, this leads to a suction force which acts downwardly towards the surface 4 of the guiding-surface member 3.

Figure 3:
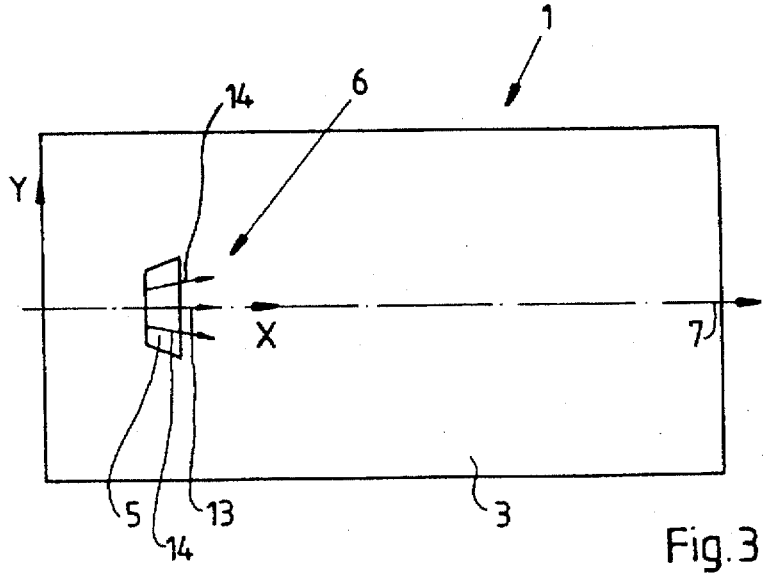
FIG. 3 is a diagrammatic view of a first embodiment of a blast-air or blowing-air nozzle for generating an air flow forming a flotation guide in the vicinity of the guiding surface.

FIG. 3 is a top plan view of the guiding-surface member 3 of the flotation guide 1. It is believed to be readily apparent that the air jets 13 escaping from an air-blast nozzle 5 and forming the air flow 6 have a main component in the X direction which extends in the sheet-transport or travel direction 7, and that, furthermore, cross-flow components are provided which lead to air-flow components 14 extending obliquely or at an inclination to the sheet-transport or travel direction 7. In particular, the air-flow components 14 are disposed symmetrically to the sheet-transport or travel direction 7, due to which the respective sheet 10 is evenly tautened towards the side edges thereof. Due to all of the foregoing, the air flow 6 consequently has a main component extending in the X direction, and secondary components extending in the Y direction which, in accordance with cartesian coordinates, is perpendicular to the X direction.

Figure 4:
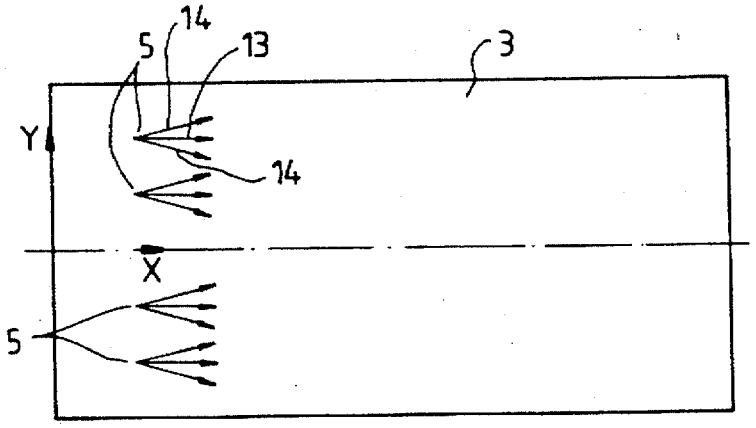
FIG. 4 is a view like that of FIG. 3 of a second embodiment of the invention.

FIG. 4 clearly illustrates that a multiplicity of air-blast nozzles 5 may be provided in the vicinity of the guiding surface member 3, and may produce air jets 13 extending in the X direction as well as air-flow components 14 extending obliquely, i.e., at an inclination, thereto.

Figure 5:
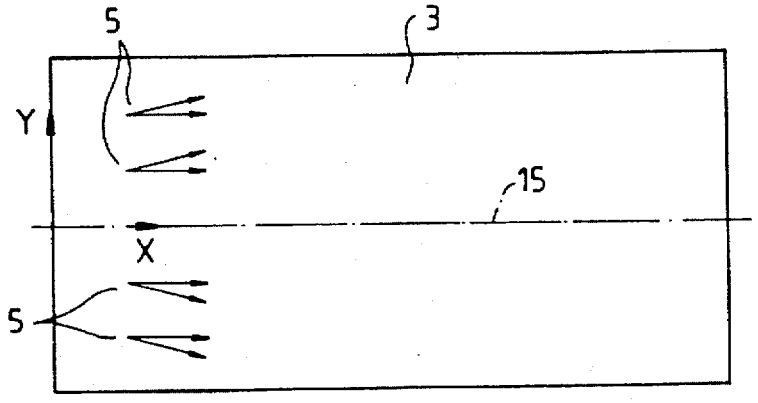
FIG. 5 is another view like that of FIG. 3 of a third embodiment of the invention.

Deviating from the embodiment of the invention shown in FIG. 4, the embodiment shown in FIG. 5 has air-blast nozzles 5 which are disposed about an axis of symmetry 15 which extends in the X directions and centrally divides the guiding surface member 3 so that, on one side of the symmetry axis 15, the air-blast nozzles 5 have a component in the X direction, as well as a component in the Y direction towards the outside edge. In order to form a symmetrical structure, corresponding air-blast nozzles 5 are provided on the other side of the axis of symmetry 15 and, likewise, have a component in the X direction, as well as components in the Y direction, which are disposed towards the other side edge.

Figure 6:
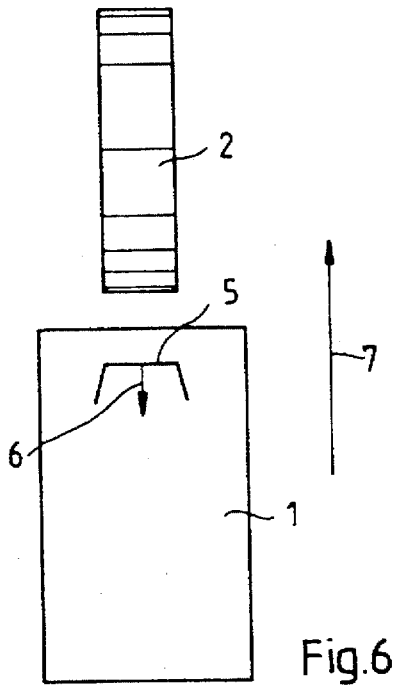
FIG. 6 is a diagrammatic view of the arrangement of the flotation guide at a location before or upstream of the sheet slow-down device, as viewed in the sheet travel direction, the direction in which the blast air is blown by the respective nozzle being opposite to the sheet travel direction.
Figure 7:
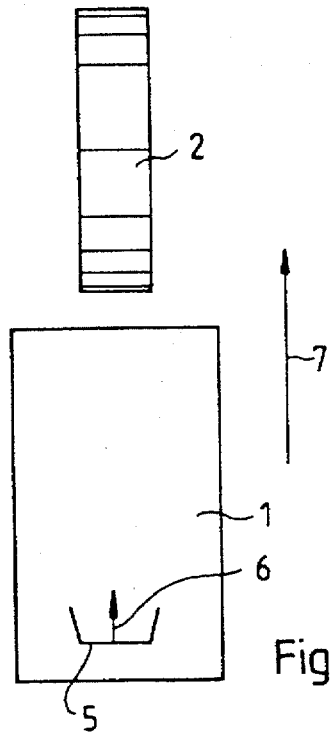
FIG. 7 is a view like that of FIG. 6, wherein the flotation guide is positioned before or upstream of the sheet slow-down device, as viewed in the sheet travel direction, however, the direction in which the blast air is blown is in the sheet travel direction.

According to FIG. 6, it is possible to arrange the flotation-guide 1 before or upstream of the sheet slow-down device 2, as viewed in the sheet-transport or travel direction represented by the arrow 7. According to another embodiment shown in FIG. 7, the flotation-guide 1 is also arranged before or upstream of the sheet slow-down device 2, as viewed once again in the sheet-transport or travel direction 7. However, in the embodiment of FIG. 6, the flotation-guiding arrangement 1 has an air flow 6 which is aimed opposite to the sheet-transport direction 7 whereas, in the embodiment of FIG. 7, the air flow 6 of the air-blast nozzle 5 is aimed in the sheet-transport direction 7.

Figure 8:
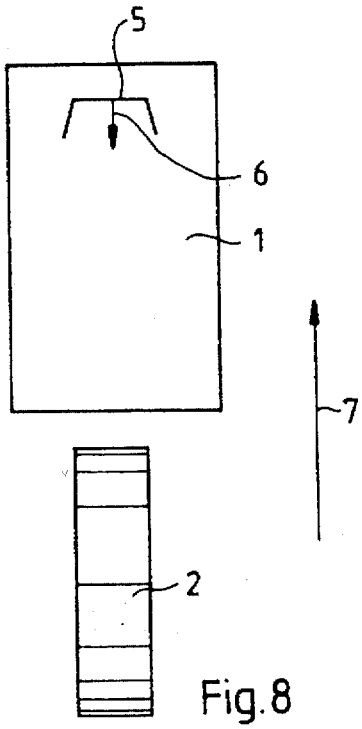
FIG. 8 is a view like that of FIG. 6, wherein, however, the flotation guide is positioned after or downstream of the sheet slow-down device, as viewed in the sheet travel direction, the direction in which the blast air is blown being opposite to the sheet travel direction.

In the embodiment of the invention shown in FIG. 8, the sheet slow-down device 2 is situated before or upstream of the flotation-guide 1, as viewed in the sheet-transport direction 7, the flotation-guide 1 having air-blast nozzles 5, which produce an air flow 6 directed opposite to the sheet-transport direction 7.

Figure 9:
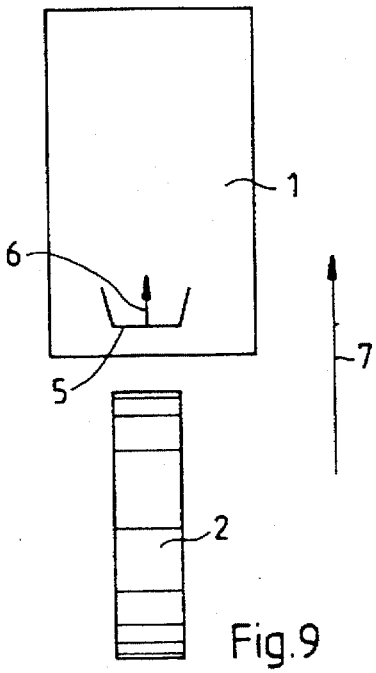
FIG. 9 is a view like that of FIG. 6, wherein the flotation guide is positioned after or downstream of the sheet slow-down device, as viewed in the sheet travel direction, the direction in which the blast air is blown being in the sheet travel direction.

As shown in FIG. 9, a modified embodiment of the invention is also conceivable wherein, in turn, the flotation-guide 1 is positioned after or downstream from the sheet slow-down device 2, as viewed in the sheet-transport direction 7, while the air flow 6, however, is directed in the sheet-transport direction 7.

Figure 10:
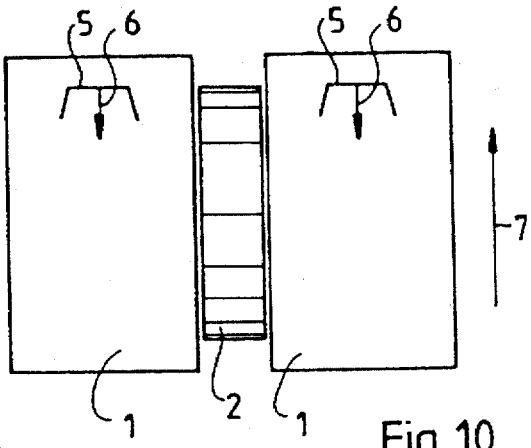
FIG. 10 is a view like that of FIG. 6, wherein the flotation guide is positioned laterally adjacent the sheet slow-down device, and the blast-air direction is opposite to the sheet travel direction.

As shown in FIG. 10, it is further conceivable for the flotation-guide 1 to be situated at a side of the sheet slow-down device 2 and to be provided, as illustrated therein, by way of example, with two air-blast nozzles 5 which are situated, respectively, on either side of the sheet slow-down device 2, the flotation-guide 1 being directed opposite to the sheet-transport direction represented by the arrow 7.

Figure 11:
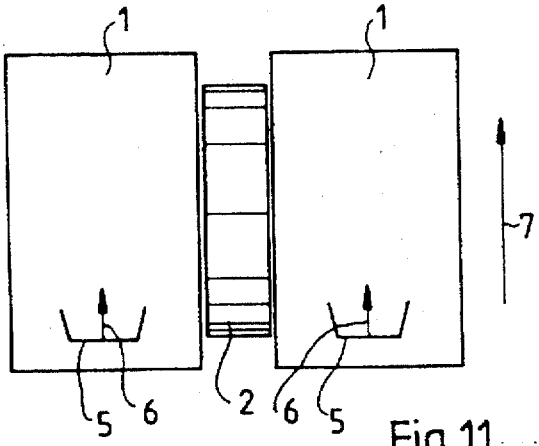
FIG. 11 is a view like that of FIG. 10, wherein the flotation guide is positioned laterally adjacent the sheet slow-down device, and the blast-air direction is in the sheet travel direction.

FIG. 11 shows an embodiment corresponding to the embodiment of the invention illustrated in FIG. 10, of which, the respective flotation guides 1, once again, are disposed at the respective sides of the sheet slow-down device 2, however, with the air flow 6 being directed in the sheet-transport direction 7.

Figure 12:
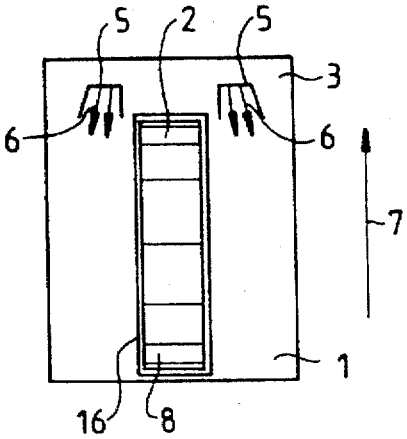
FIG. 12 is a view like that of FIG. 6 of an integrated construction of the sheet slow-down device and the flotation guide, the blast-air direction being opposite to the sheet travel direction.
Figure 13:
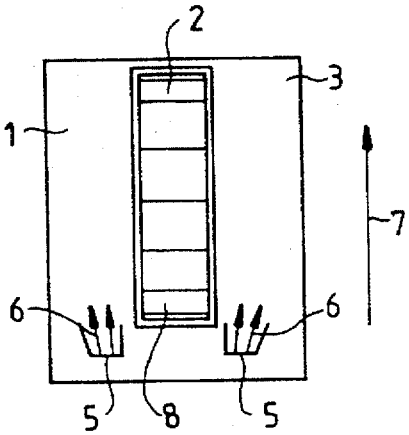
FIG. 13 is a view like that of FIG. 12 of an integrated construction of the sheet slow-down device and the flotation guide, the blast-air direction being in the sheet travel direction.

Finally, FIGS. 12 and 13 show embodiments of the invention wherein the flotation guide 1 and the sheet slow-down device 2 form an integral component, the guiding surface member 3 of the flotation guide 1 being formed with a recess or cutout 16 wherein the suction roller 8 of the sheet slow-down device 2 is received. The respective air-blast nozzles 5 are disposed on either side of the suction rollers 8 and are located, in the one case represented in FIG. 12, after or downstream from the sheet slow-down device 2, as viewed in the sheet-transport direction 7, with the air flow 6 directed opposite to the sheet-transport direction 7 and, in the other case represented in FIG. 13, before or upstream of the sheet slow-down device 2, as viewed in the sheet-transport direction 7, with the air flow 6 acting in the same general direction as the sheet-transport direction 7.

In FIGS. 6 to 13, only the main component of the air flow 6 is shown, however, it is believed to be readily apparent that cross-flow components may be present, as described hereinbefore with respect to FIGS. 3 to 5.

Of course, further embodiments of the invention other than those shown in FIGS. 6 to 13 are possible. Moreover, combinations of these embodiments may also be formed.

We claim:

1. Method for guiding a sheet in the vicinity of a sheet slow-down device of a sheet-processing machine, which includes gripping the sheet at a leading edge thereof and transporting the sheet in a sheet-transport direction along a sheet travel path, the sheet having a defined region with which the sheet comes into contact with a sheet slow-down device for subsequently forming a sheet pile, which comprises directing the sheet, in the vicinity of the sheet slow-down device, into a range of influence of a flotation guide produced along a guiding surface member by an air flow, the flotation guide having an air flow in the sheet transport direction and, without taking into account the influence of the sheet slow-down device, being effective for bringing the sheet to a normal flotation level located above the guiding surface member, and supplying the sheet to the sheet slow-down device at a height level above the normal flotation level in order to form sheet-stabilizing vacuum forces resulting from the air flow.

2. Method according to claim 1, wherein the height level is at a given spaced distance above the normal flotation level, the given distance being greater than sheet-movement amplitudes potentially occurring in a sheet located at the normal flotation level.

3. Method according to claim 1, wherein the air flow of the flotation guide has at least one cross-flow component extending transversely to the sheet-transport direction.

4. Method according to claim 1, wherein the air flow of the flotation guide has a plurality of cross-flow components disposed symmetrically with respect to the sheet-transport direction.

5. Method according to claim 1, wherein the flotation guide is disposed upstream of the sheet slow-down device, as viewed in the sheet-transport direction.

6. Method according to claim 1, wherein the flotation guide is disposed downstream of the sheet slow-down device, as viewed in the sheet-transport direction.

7. Method according to claim 1, wherein the flotation guide is disposed laterally adjacent the sheet slow-down device, as viewed in the sheet-transport direction.

8. Device for guiding a sheet in the vicinity of a sheet slow-down device of a sheet-processing machine, wherein the sheet is gripped at a leading edge thereof and transported along a sheet travel path, the sheet having a defined region at which the sheet comes into contact with the sheet slow-down device for subsequently forming a sheet pile, comprising the sheet slow-down device and a flotation guide formed in the vicinity of and a given distance below an effective contact surface of the sheet slow-down device, said flotation guide comprising a guiding surface member and an air flow device for directing air flow along the guiding surface member and in the sheet transport direction, the air flow, without taking into account the influence of the sheet slow-down device, being effective for bringing the sheet to a normal flotation level located above the guiding surface member but below the effective contact surface of the sheet slow-down device, the sheet being supplied to the sheet slow-down device at the given distance above the flotation guide and above the normal flotation level in order to form sheet-stabilizing vacuum forces resulting from the air flow.

* * * * *